US006279362B1

(12) United States Patent
Lee

(10) Patent No.: US 6,279,362 B1
(45) Date of Patent: Aug. 28, 2001

(54) BELT CLIP ASSEMBLY

(76) Inventor: Geon Woo Lee, 1043 S. Berendo St., Los Angeles, CA (US) 90006

( * ) Notice: Subject to any disclaimer, the term of this patent is extended or adjusted under 35 U.S.C. 154(b) by 0 days.

(21) Appl. No.: 09/426,524

(22) Filed: Oct. 26, 1999

Related U.S. Application Data

(63) Continuation-in-part of application No. 08/675,492, filed on Jul. 3, 1996, now Pat. No. 5,983,686.

(51) Int. Cl.[7] ..... A44B 15/00; A45C 11/32; A47G 29/10

(52) U.S. Cl. ..... 70/456 R; 70/459

(58) Field of Search ..... 70/456 R, 459; 24/3.12, 3.6; 224/269, 667

(56) References Cited

U.S. PATENT DOCUMENTS

| | | | | |
|---|---|---|---|---|
| 267,112 | | 11/1882 | Sanderson | 70/459 |
| 806,632 | | 12/1905 | Breer | 24/3.11 |
| 926,401 | | 6/1909 | Freedman | 24/3.11 |
| 1,212,511 | | 1/1917 | Kropp | 24/3.6 |
| 1,302,067 | | 4/1919 | Mendelsohn | 24/3.6 |
| 1,304,403 | | 5/1919 | Storch et al. | 24/3.12 |
| 1,417,129 | * | 5/1922 | Armstrong | 24/508 |
| 1,419,408 | | 6/1922 | Polhemus | 24/3.12 |
| 1,484,508 | | 2/1924 | Lasserre | 24/3.6 |
| 1,724,003 | | 8/1929 | Chamberlain | 70/459 |
| 1,848,032 | | 3/1932 | Tessier | 24/3.6 |
| 2,551,515 | * | 5/1951 | Tschirf | 224/180 |
| 2,869,198 | * | 1/1959 | Clevitt, Jr. | 24/3.12 |
| 2,869,354 | * | 1/1959 | Huntley | 70/456 R |
| 4,113,156 | | 9/1978 | Brito | 224/5 R |
| 4,391,113 | | 7/1983 | Jorgens | 70/459 |
| 4,821,543 | | 4/1989 | Scungio | 70/456 R |
| 4,828,153 | | 5/1989 | Guzik et al. | 24/242 |
| 5,279,021 | | 1/1994 | Edgin | 24/647 |
| 5,426,825 | * | 6/1995 | Soren et al. | 24/3.12 |
| 5,446,947 | | 9/1995 | Lee | 24/3.6 |
| 5,664,292 | * | 9/1997 | Chen | 24/3.11 |
| 5,983,686 | * | 11/1999 | Lee | 70/456 R |

FOREIGN PATENT DOCUMENTS

| | | | |
|---|---|---|---|
| 502743 | 5/1954 | (CA) | 24/3.6 |
| 2817677 | 10/1979 | (DE) | 70/456 R |
| 2500729 | 9/1982 | (FR) | 224/269 |
| 0015604 | 5/1902 | (GB) | 24/601.5 |

* cited by examiner

*Primary Examiner*—Lynne H. Browne
*Assistant Examiner*—John B. Walsh
(74) *Attorney, Agent, or Firm*—Lee & Hong

(57) ABSTRACT

A belt clip assembly for use with a belt comprises a clip having first and second members defining a gap for slidably engaging the belt, a latch pivotally connected to a receptacle of the second member of the clip to pivot with respect to the second member. The latch has a flap member that has first and second flaps formed at a predetermined angle. The first flap extends toward the first member at an angle with respect to the second member to prevent the belt from disengaging from the clip. The belt clip assembly also has an actuating member extended through and slidably located in the second member of the clip. The actuating member has first and second ends, wherein the second end actuates the second flap when the first end is depressed. The latch has a pivot axle disposed at a joint formed by the first and second flaps and has a spring disposed in surrounding relation to the pivot axle to bias the latch in a closed position to prevent the belt from disengaging from the clip.

5 Claims, 3 Drawing Sheets

BELT CLIP ASSEMBLY

CROSS REFERENCE TO RELATED ART

This is a continuation-in-part of application Ser. No. 08/675,492, filed Jul. 3, 1996, now U.S. Pat. No. 5,983,686, which is hereby incorporated by reference in its entirety.

BACKGROUND OF THE INVENTION

1. Field of the Invention

The present invention relates generally to an attachment assembly for a belt and particularly to a locking belt clip assembly used to attach keys or portable electronic devices, such as pagers, portable radios, etc.

2. Discussion of the Related Art

Keys and portable electronic devices, such as pagers, cellular phones and portable radios are used by a large segment of the world's population. Keys and these portable electronic devices are carried on a person so that they are readily available when needed. The keys must be carried in a ring or a retainer, which itself must be supported and carried by the person. Similarly, portable electronic devices must be carried in carrying cases which must be supported by the person as well.

With regard to items such as keys and portable electronic devices, they should preferably be easily and quickly attachable and detachable from the person, most commonly the waist belt. One problem with conventional belt clips used with key rings and portable electronic devices is that it undesirably disengages from the waist belt thus resulting in misplaced items and damages to electronic devices.

The usual types of key chains comprise a string of metal beads for threading through the openings in keys. Another form of key retainer comprises a flat cylinder of overlapping turns of wire onto which a key is inserted. There are also key retainers in the form of small spaced hooks dangling from the inner surface of a case of leather or the like. However, none contain a device integral therewith which enable the keys to be clamped to a person's shirt, dress or like location. Moreover, none of such key retainers provide enlarged surfaces that are utilizable at the key sites for the imprinting, embossing or otherwise affixing advertising indicia thereto. Moreover, many of such key retainers are expensive to make and therefor not adaptable for use in advertising give-aways for sports events and the like.

Accordingly, there remains a need for a belt clip assembly with a locking mechanism which is simple and inexpensive to make and easy to use and which, in contrast to conventional belt clips, can be easily connected to and disconnected from an article of clothing or wearing apparel such as a belt, shirt or pants so as to be readily available and to prevent the loss of the items attached to the belt attachment.

SUMMARY OF THE INVENTION

Accordingly, the present invention is directed to a belt clip assembly with a locking mechanism that substantially obviates one or more of the problems due to limitations and disadvantages of the related art.

Accordingly, an object of the present invention is to provide a key or portable electronic device holder that may be securely attached to a belt and is constructed to prevent accidental disengagement from the belt.

Another object of the present invention is to provide a belt clip assembly with a latch that may be opened and closed to permit the key chain to be conveniently secured on a belt.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a belt clip assembly for use with a belt comprises a clip having first and second members defining a gap for slidably engaging the belt, a latch pivotally connected to a receptacle of the second member of the clip to pivot with respect to the second member. The latch has a flap member that has first and second flaps formed at a predetermined angle. The first flap extends toward the first member at an angle with respect to the second member to prevent the belt from disengaging from the clip. The belt clip assembly also has an actuating member extended through and slidably located in the second member of the clip. The actuating member has first and second ends, wherein the second end actuates the second flap when the first end is depressed. The latch has a pivot axle disposed at a joint formed by the first and second flaps and has a spring disposed in surrounding relation to the pivot axle to bias the latch in a closed position to prevent the belt from disengaging from the clip.

In one aspect of the present invention, the actuating member includes an actuating rod, a pin extending therefrom and a coil located in surrounding relation to the pin to bias the actuating member away from the second flap. Preferably, the actuating member includes a cap connected to the actuating rod.

In a second embodiment of the present invention, the latch is actuated with a thumb. In such embodiment, the second member has an opening for receiving the second flap of the latch therethrough. The second flap is pivoted by a user.

According to another aspect of the present invention, the belt clip assembly may be used with a pager case for wearing on a belt. Such pager case comprises a lid configured to receive a pager; a base pivotally connected to and surroundingly fit the lid; a clip having first and second members defining a gap for slidably engaging the belt, wherein the second member has a receptacle and is integrally formed as the base; a latch pivotally connected to the receptacle of the second member of the clip to pivot with respect to the second member, the latch having a flap member that has first and second flaps formed at a predetermined angle, wherein the first flap extends toward the first member at an angle with respect to the second member to prevent the belt from disengaging from the clip; and a lever that pivots with respect to the latch, the lever having first and second ends, the second end being disposed adjacent the second flap to tilt the latch when the first end of the lever is actuated.

According to one aspect of the invention, the latch pivots using an edge of the second flap away from first flap as a center. The second end of the lever is located under the second flap to lift the latch for disengaging the belt.

Alternatively, the latch pivots using a joint of the first and second flaps as a center. The second end of the lever is located over the second flap to lift the latch for disengaging the belt.

The lid of the pager case opens away from the base to expose a display area of the pager therein to face an observer.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Now referring more particularly to FIGS. 1–8D of the drawings, preferred embodiments of the belt clip assembly of the present invention is schematically depicted therein.

Figure 1:
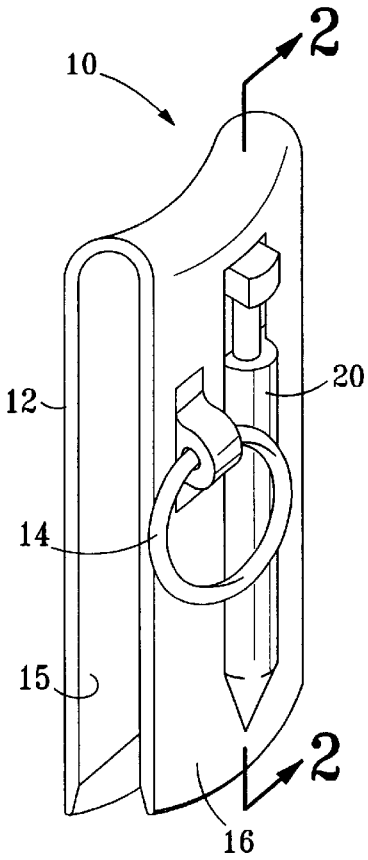
FIG. 1 is a perspective view of a belt clip assembly according to a first embodiment of the present invention.

FIG. 1 is a perspective view of a belt clip assembly according to a first embodiment of the present invention. Referring to FIG. 1, the belt clip assembly 10 comprises a clip housing 12, a key retainer 14 and a release member 20 integrally formed in the clip housing 12.

The clip housing 12 is of a substantially U-shape with two parallel inner and outer members 15 and 16 extending from a common joint. The parallel inner and outer members 15 and 16 are separated by a distance which is sufficient to slidably receive a belt 19 therein. The release member 20 is formed laterally along the length of the outer flap 16, adjacent to the key retainer 14. However, the position of the key retainer 14 and the release member 20 may vary so long as the release member 20 can actuate a swivel latch 30 (shown in FIGS. 2 and 3) for disengaging the belt 19 from the clip housing 12.

Figure 2:
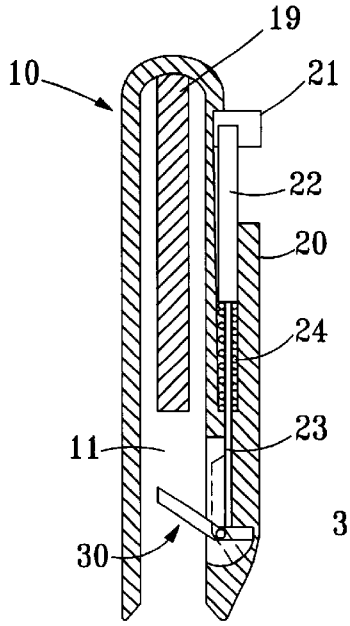
FIG. 2 is a cross-sectional view of the belt clip assembly along line 2—2 in FIG. 1.
Figure 3:
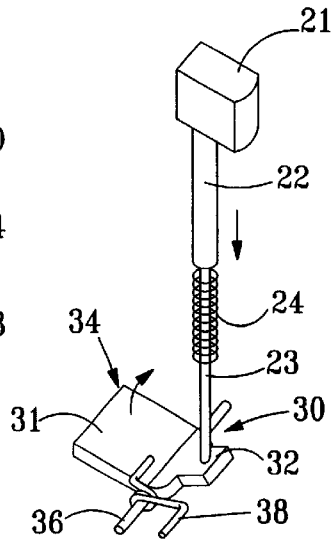
FIG. 3 is a perspective view of a release member used in the belt clip assembly of FIG. 1.

FIG. 2 is a cross-sectional view of the belt clip assembly 10 along line 2—2 in FIG. 1. FIG. 3 is a perspective view of a release member 20 in the belt clip assembly 10 of FIG. 1. According to FIGS. 2 and 3, the release member 20 includes an actuating rod 22, a pin 23 connected to and extending from the actuating rod 22 and a swivel latch 30 placed at a lower end of the pin 23.

Preferably, the release member 20 is disposed inside a release member housing defined by the outer member 16 of the clip housing 12. One end of the actuating rod 22 has a cap 21 that is used with a user's thumb to press down on the actuating rod 22. The release member housing preferably comprises a cylindrical bore formed in the outer member 16 for slidably receiving the actuating rod 22 and the pin 23 extending therefrom. There is also a coil or spring 24 disposed or placed in surrounding relation to the pin 23 immediate below the actuating rod 22. The purpose of the coil 24 is to bias the actuating rod 22 and the pin 23 connected thereto away from the swivel latch 30 to prevent the belt clip assembly 10 from disengaging a belt 19.

In the preferred embodiment, there is provided a cap 21 which preferably abuts against a notch 18 formed in the outer flap 16 to prevent the actuating rod 22 from dislodged from the release member housing. The cap 21 can be separately fastened to the actuating rod 22 or alternatively can be made as an integral member of the actuating rod 22.

FIGS. 2 and 3 also illustrate the latch 30 which is used for engaging (locking) and disengaging (unlocking) the belt clip assembly 10 from a belt 19. The latch 30 comprises a flap member 34 that has a first flap 31 slantly attached to a second flap 32 to form preferably an obtuse angle. The flap member 34 is pivotally connected to the release member housing and is actuated by the pin 23. When installed, the first flap 31 extends into a gap 11 formed between the inner and outer members 15 and 16 of the clip 12 to prevent disengagement of the belt 19.

The latch 30 also includes a pivoting axle 36 horizontally placed in the release member housing. The pivoting axle 36 is slidably inserted in the joint formed by the first and second flaps 31 and 32. The latch 30 also has a spring 38 located in surrounding relation to the pivoting axle 36 to bias the flap member 34 in a lock position, where the first flap 31 extends inside the gap 11 of the clip 12.

The belt clip assembly 10 according to the first embodiment is worn on a person by vertically sliding it, for example, on a waist belt. Alternatively, the present invention may be used on purse straps, an article of clothing or other similar places. Because the first flap 31 is at an angle, as shown in FIG. 2, the belt 19 slides between the gap 11 formed by the first and second members 14 and 15 without any intervention. Once the belt 19 is in the clip 12, the spring 38 biases the latch 30 in a closed position. As a result, the latch 30 and the clip 12 form a substantially closed loop thereby trapping the belt 19 therein.

To disengage the belt 19, the lever 21 connected to the actuating rod 22 is simply depressed with a thumb, which in turn presses the second flap 32 of the latch 30 in a downward direction. The first flap 31 is then lifted to a position illustrated as dotted lines in FIG. 2, allowing the present invention to be removed from the belt 19.

Figure 4:
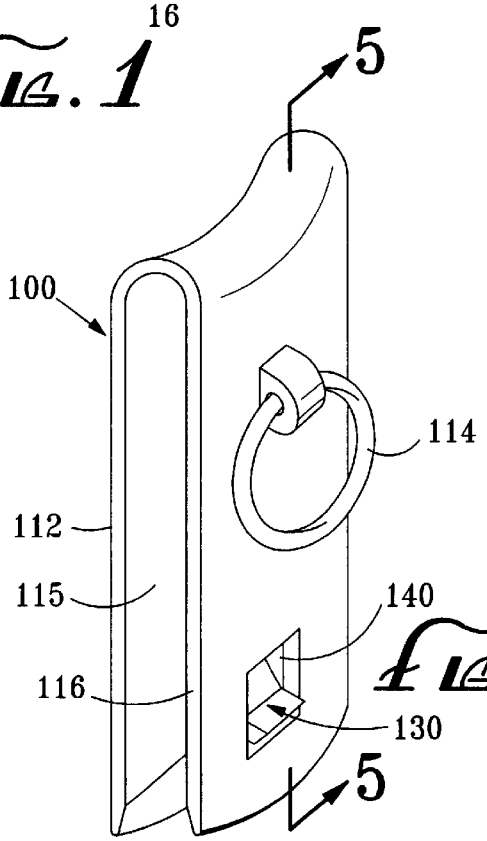
FIG. 4 is a perspective view of a belt clip assembly according to a second embodiment of the present invention.

FIG. 4 is a perspective view of a belt clip assembly 100 according to a second embodiment of the present invention. The belt clip assembly 100 according to the second embodiment is similar to that of the first embodiment shown in FIG. 1, except that the release member 20 is not present. In the second embodiment, the latch 130 is directly pivoted by a user, preferably with a thumb.

In the second embodiment, the latch 130 is pivotally coupled to a rectangular or square opening 140 defined by the outer member 116, which is parallely disposed with respect to the inner member 115. Although the length and width of the inner and the outer members 115 and 116 are shown to be substantially identical, the length and width of each member may be different depending on the application and design criteria without deviating from the gist of the present invention.

Figure 5:
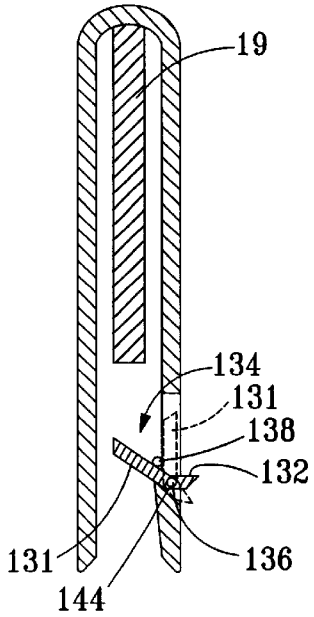
FIG. 5 is a cross-sectional view of the belt clip assembly along line 5—5 in FIG. 4.

FIG. 5 is a cross-sectional view of the belt clip assembly along line 5—5 in FIG. 4. According to FIG. 5, two positions of the latch 130 is shown. The latch 130 represented by a solid line illustrates when the latch 130 is in an engagement or locking position. The latch 130 represented by dotted lines illustrates when the latch 130 is in a disengagement or unlocking position.

The latch 130 comprises a flap member 134 that has a first flap 131 connected to a second flap 132 to preferably form an obtuse angle. The flap member 134 is pivotally connected in the opening 140 defined by walls of the outer member 116. When installed, the first flap 131 extends into a gap formed between the inner and outer members 115 and 116 of the clip 112 to prevent disengagement of the belt 19.

The latch 130 also includes a pivoting axle 136 horizontally placed between opposite walls of the opening 140. The pivoting axle 136 is slidably inserted in the joint formed by the first and second flaps 131 and 132. The latch 130 also has a spring 138 located in surrounding relation to the pivoting axle 136 to bias the flap member 134 in a lock position, where the first flap 131 extends inside the clip 112.

The second flap 132 is of a sufficient length to extend the wall of the outer member 116 to allow the latch 130 to be manually tilted with a user's thumb. The length of the first flap 131 is sufficiently long to prevent the belt 19 from disengaging from the clip 112 when the latch 130 is in a locking position. The opening 140 has a lower stop wall 144 inwardly protruding from the inner surface of the outer member 116 to limit the downward pivoting movement of the first flap 131 in a locking position.

The operation of the second embodiment is similar to the first embodiment. To disengage the belt 19, the second flap 132 protruding from the outer member 116 of the clip 112 is pressed down by a thumb. The first flap 131 is then lifted in a position illustrated as dotted lines in FIG. 5, allowing the clip 112 according to the present invention to be removed from the belt 19.

Preferably, components of the present invention may be made with any suitably rigid materials known to one of ordinary skill in the art, such as aluminum, plastic, metal, etc.

FIGS. 6 to 8D illustrate a belt clip assembly integrally constructed as a pager case according to a third embodiment of the present invention. FIGS. 7A to 7D uses a first type of lever to control the pivoting movement of the latch. FIGS. 8A to 8D use a second type of lever to perform the same function.

Figure 6:
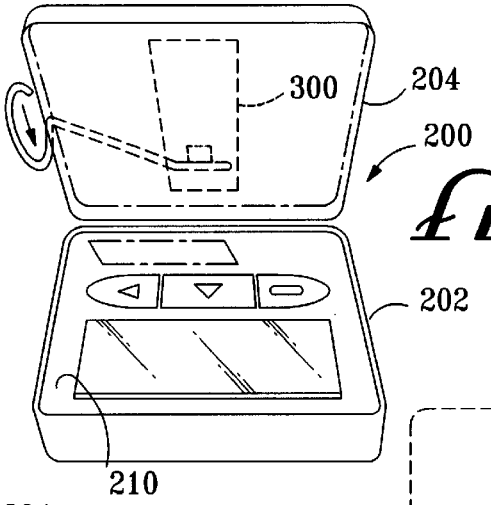
FIG. 6 is a perspective view of a belt clip assembly of the present invention integrally constructed as a pager case.
Figure 7A:
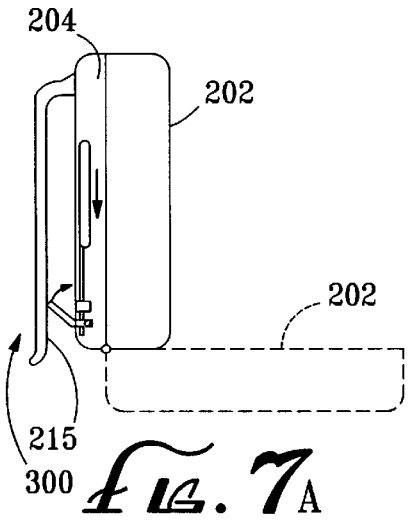
FIG. 7A is a side plan view of FIG. 6 using a lever designed to be actuated in one direction.

According to FIG. 6, there is shown a pager case 200 to be worn on a belt of a person. FIGS. 7A to 7D illustrate a belt clip assembly wherein the latch 330 (shown in FIG. 7B) is actuated by pushing the lever 350 in a downward direction. Referring to FIGS. 7A and 7B, the pager case 200 comprises a base 204 and a lid 202 constructed to hold a pager 210. The base 204 and the lid 202 are pivotally connected so that the lid 202 flip open in a downward fashion as shown as dotted lines in FIG. 7A to expose the front of the pager 210 for easy and convenience observation of the pager's display without the necessity of removing the pager 210 from the case 200. As shown in FIG. 7A, the lid 202 in a solid line illustrates a closed position of the lid, and the lid 202 in a dotted line illustrates an open position.

The base 204 of the case 200 is constructed to house the belt clip assembly 300. Extending from the base 204 is an inner clip 215 which is operates with the base 204 to hold a belt therebetween. The belt clip assembly 300, as shown in FIG. 7B, comprises a latch 330 pivotally connected to the base 204 through an axle 336 which is biased with a spring 338. In addition, there is provided a lever 350 for pivoting the latch 330. One end of the lever 350 is formed in a shape of a loop to function as a key ring 352. An actuating portion 354 of the lever 350 is disposed at the opposite end of the key ring 352 and is preferably located under the latch 330.

Similar to the first and second embodiments, the latch 330 comprises a flap member 334 that has a first flap 331 connected to a second flap 332 to preferably form an obtuse angle. The flap member 334 is pivotally connected in the wall of the base 204 of the pager case 200 as shown in FIG. 7A. When installed, the first flap 331 extends into a gap formed between the inner clip 215 and the base 204 of the pager case 200 to prevent disengagement of the belt.

The latch 330 also includes a pivoting axle 336. The pivoting axle 336 is slidably inserted in a pivot hole formed across the width of the second flap 332. The latch 330 also has a spring 338 located in surrounding relation to the pivoting axle 336 to bias the flap member 334 in a lock position, where the first flap 331 extends toward the inner clip 215.

The actuating portion 354 of the lever 350 extends under the second flap 332 and is located between the first flap 331 and the axle 336. Alternatively, the actuating portion 354 may be located under the first flap 331 while the axle 336 is disposed at the joint formed by the first and second flaps 331 and 332.

The lever 350 pivots with respect to the base 204 of the pager case 200 by use of an axle 356 embedded in the base 204 of the pager case 200. In addition, in FIG. 7B, the lever 350 is biased with a spring 358 so that the lever 350 is pushed upward with respect to the base 204. By use of two springs 338 and 358, the latch 330 is biased in the locking position until the lever 350 is pushed in a downward direction.

Figure 7C:
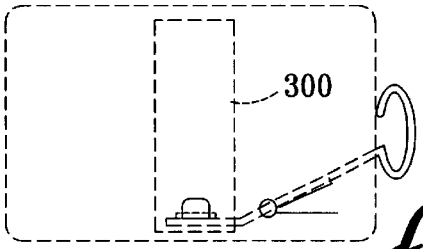
FIGS. 7C to 7D illustrate a belt clip assembly used with a lever shown in FIG. 7B.
Figure 7D:
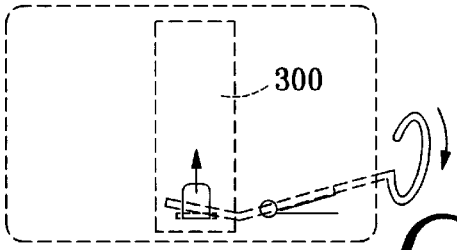
Figure 7B:
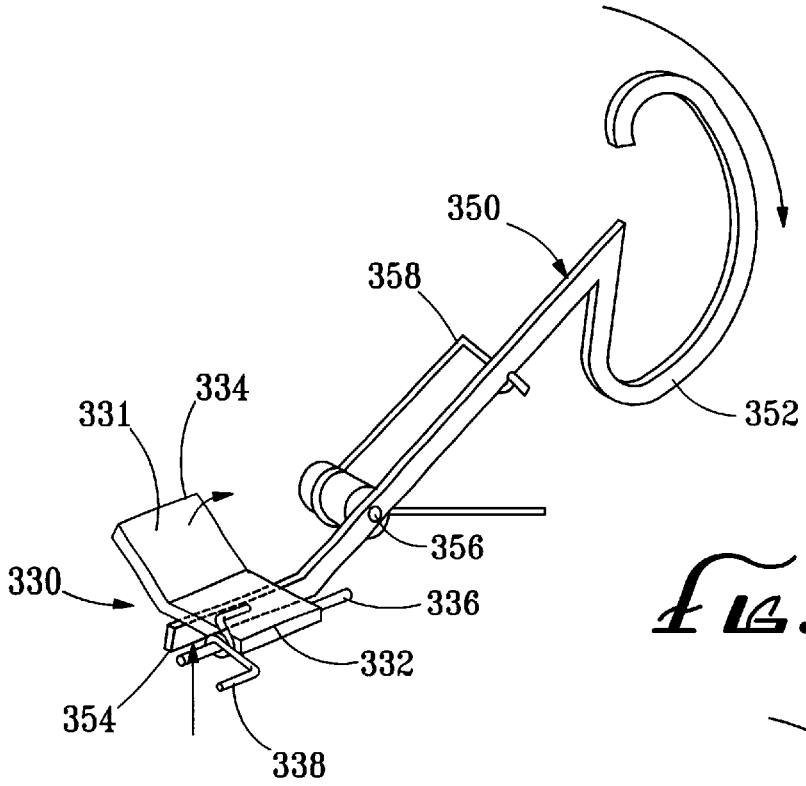
FIG. 7B illustrates is a belt clip assembly used in the pager case of FIG. 6.

FIGS. 7C to 7D illustrate a belt clip assembly 300 used with the lever 350 that has to be pushed downward to disengage the belt. As shown in FIG. 7C, when the lever 350 is in a upper position, the latch 330 is in the locking position, and the key ring 352 is closed. Referring to FIG. 7D, when the lever 350 is in a down position, the latch 330 is in the unlocking position, and the key ring 352 is open for installing or removing keys.

Figure 8A:
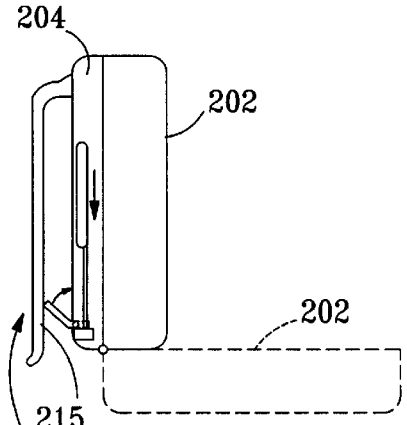
FIG. 8A is a side plan view of FIG. 6 using a lever designed to actuate at a different pivot point.
Figure 8C:
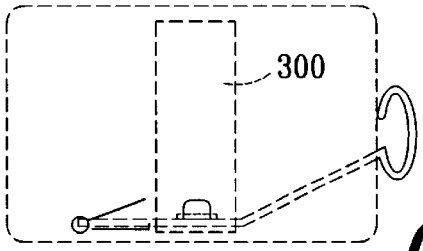
FIGS. 8C to 8D illustrate a belt clip assembly used with a lever shown in FIG. 8B.
Figure 8D:
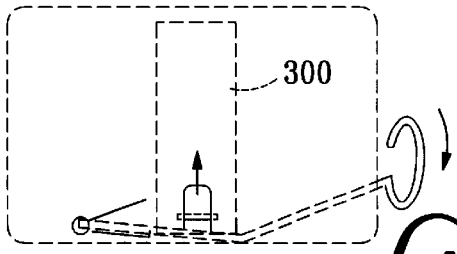
Figure 8B:
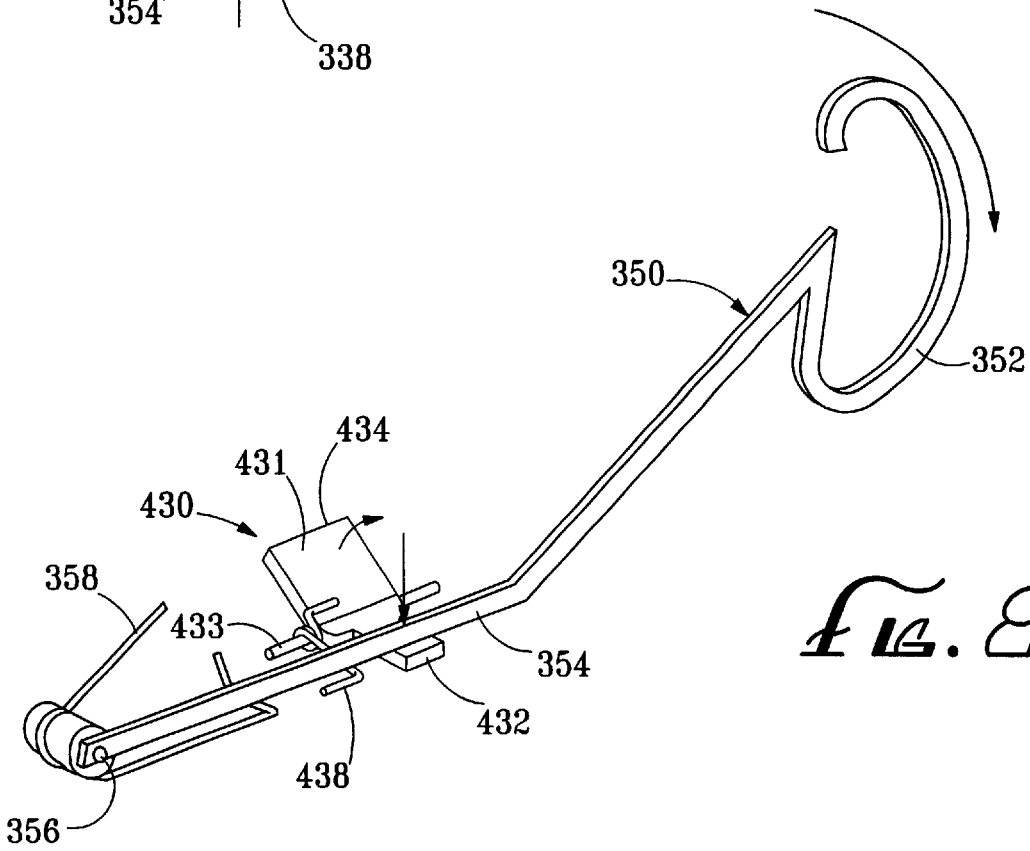
FIG. 8B illustrates a belt clip assembly of FIG. 8A used in the pager case of FIG. 6.

FIGS. 8A to 8D also illustrate a belt clip assembly 300 wherein a latch 430 (shown in FIG. 8B) is actuated by pushing the lever 350 in a downward direction. Referring to FIGS. 8A and 8B, the belt clip assembly comprises a latch 430 pivotally connected to the base 204 through an axle 433 which is biased with a spring 438. In addition, there is provided a lever 350 for pivoting the latch 430. One end of the lever 350 is formed in a shape of a loop to function as a key ring 352. An actuating portion 354 of the lever 350 is disposed at the opposite end of the key ring 352 and is preferably located above a second flap 432 of the latch 430.

Similar to the first and second embodiments, the latch 430 comprises a flap member 434 that has a first flap 431 connected to a second flap 432 to preferably form an obtuse angle. The flap member 434 is pivotally connected in the wall of the base 204 of the pager case 200. When installed, the first flap 431 extends into a gap formed between the inner clip 215 and the base 204 of the pager case 200 to prevent disengagement of the belt.

The latch 430 also includes a pivoting axle 433. The pivoting axle 436 is slidably inserted in a hole formed across the width of the second flap 432. The latch 430 also has a spring 438 located in surrounding relation to the pivoting axle 436 to bias the flap member 434 in a lock position, where the first flap 431 extends toward the inner clip 215. Preferably, the actuating portion 354 of the lever 350 extends over the second flap 432.

The lever 350 pivots with respect to the base 204 of the pager case 200 by use of an axle 356 embedded in the base 204. In addition, in FIG. 8B, the lever 350 is biased with a spring 358 so that the lever 350 is pushed downward with respect to the base 204. By use of two springs 438 and 358, the latch 430 is biased in the locking position until the lever 350 is tilted in a downward direction to disengage the belt.

FIGS. 8C to 8D illustrate a belt clip assembly used with the lever 350 that has to be tilted downward to disengage the belt. As shown in FIG. 8C, when the lever 350 is in an upper position, the latch 430 is in the locking position. Referring to FIG. 8D, when the lever 350 is tilted in a downward direction, the latch 430 is in the unlocking position.

Although the present invention has been described with regard to a key ring and a pager, the belt attachment apparatus of the present invention may also be used with cases for cellular phone, portable electronic devices, etc.

It will be apparent to those skilled in the art that various modifications and variation can be made in the present invention without departing from the spirit or scope of the invention. Thus, it is intended that the present invention covers the modifications and variations of this invention provided they come within the scope of the appended claims and their equivalents.

What is claimed is:

1. A pager case for use with a belt, the pager case comprising:

a lid configured to receive a pager;

a base pivotally connected to and surroundingly fit the lid;

a clip having first and second members defining a gap for slidably engaging the belt, wherein the second member has a receptacle and is integrally formed as the base;

a latch pivotally connected to the receptacle of the second member of the clip to pivot with respect to the second member, the latch having a flap member that has first and second flaps formed at a predetermined angle, wherein the first flap extends toward the first member at an angle with respect to the second member to prevent the belt from disengaging from the clip; and a lever that pivots with respect to the latch, the lever having first and second ends, the second end being disposed adjacent the second flap to tilt the latch when the first end of the lever is actuated.

2. The pager case of claim 1, wherein the latch pivots using an edge of the second flap away from first flap as a center, the second end of the lever being located under the second flap to lift the latch for disengaging the belt.

3. The pager case of claim 1, wherein the latch pivots using a joint of the first and second flaps as a center, the second end of the lever being located over the second flap to tilt the latch for disengaging the belt.

4. The pager case of claim 1, wherein the lid opens away from the base to expose a display area of the pager therein to face an observer.

5. The pager case of claim 3, wherein the latch includes a spring for biasing the latch against the second end of the lever.

* * * * *